United States Patent [19]

Levitz

[11] 3,945,467

[45] Mar. 23, 1976

[54] RETAIL FURNITURE DISPLAY AND SALES FACILITY

[75] Inventor: Ralph Levitz, Miami, Fla.

[73] Assignee: Levitz Furniture Corporation, Miami, Fla.

[22] Filed: Mar. 3, 1975

[21] Appl. No.: 554,904

Related U.S. Application Data

[62] Division of Ser. No. 357,951, May 7, 1973, abandoned.

[52] U.S. Cl. ..... 186/1 R; 35/55; 312/234.1

[51] Int. Cl.[2] ..... E04H 3/04

[58] Field of Search ..... 186/1 R, 1 B; 35/55; 312/234, 234.1

[56] References Cited

UNITED STATES PATENTS 1,377,813 5/1921 Dlugach ..... 186/1 R X 3,412,485 11/1968 Reigler ..... 35/55

*Primary Examiner*—Robert J. Spar
*Assistant Examiner*—George F. Abraham
*Attorney, Agent, or Firm*—Don J. Flickinger

[57] ABSTRACT

A retail furniture sales display module has an illuminated photograph of household furnishings shown in a coordinated room setting and a tactile display of fragmentary physical samples of the furnishings. A plurality of the modules are arranged within a sales facility building. Actual sample items may be displayed on a mezzanine floor above the module arrangement and a warehouse having an available supply of the furnishings is adjacent the module arrangement.

2 Claims, 14 Drawing Figures

RETAIL FURNITURE DISPLAY AND SALES FACILITY

The instant application is a divisional case of prior filed co-pending application Ser. No. 357,951, filed May 7, 1973, entitled RETAIL FURNITURE DISPLAY AND SALES FACILITY, inventor - Ralph Levitz, now abandoned.

This invention relates to a retail furniture sales facility.

More particularly, the invention relates to a retail furniture sales facility with novel means for displaying household furnishings.

In a further aspect, the invention concerns a retail furniture sales facility wherein numerous displays of household furnishings in room settings are present for consideration by the customer within substantially less area than required for conventional display.

In further further aspect, the invention concerns a novel retail sales facility with an integral mezzanine for displaying representative furniture items and a warehouse for storing an available supply of household furnishings.

Household furnishings, including furniture, accessories and decorator items, are a necessary commodity. From large metropolitan cities to small suburban and rural communities, persons periodically purchase household furnishings to furnish new homes, to replace worn-out items, and to change decor. The type of item, such as sofa, chair, dinette set or bedroom suite, is dictated by the customer's need. The style varies according to the customer's aesthetic preference, style of home, intended use, geographic location, and numerous other criteria. To adequately accommodate potential customers and insure business success, the enterprising merchant must, therefore, have a copious display of furnishings.

For very practical reasons, however, the prudent retailer must limit his investment and, consequently, the displays of furnishings in accordance with the potential market. In populous areas, for example, are spacious, often multi-story furniture sales facilities having a large offering. While some stores simply have all like items crowded together, other stores having extraordinary floor space may display furniture in room-like arrangements. When inspecting furniture presented in room settings, the customer more readily visualize the items as they would appear within his home. This type of retail facility usually has a warehouse located in a commercial section of the city from where the customer's selection is delivered within a few days.

Recently, conventional retail furniture stores located in metropolitan business districts have been widely displaced by combination warehouse-showroom facilities located in outlying areas. This new type of facility offers the customer ultimate convenience and service in accordance with present technology. The potential retail customer can usually reach such sales facilities more quickly and conveniently as they are located on major highways away from normally congested downtown business districts. Located in districts where land is less valuable and without the necessity of ostentatious architecture, the merchant can erect an extemely large building. The building contains a spacious showroom displaying an extensive variety of home furnishings and a warehouse for storing ample quantities of the furnishings.

After making his selection, the customer may have his merchandise immediately removed from the warehouse and loaded into his personal vehicle, or alternatively, have the merchandise delivered by the company within a few days. It is obvious that the combination warehouse-showroom operation offers the customer an ample selection and substantial savings.

Special display techniques have been developed to complement the warehouse-showroom facility described above. The showroom, located in a separate area adjacent to the warehouse storage area, is divided by numerous elongate partitions into aisles not substantially wider than a room in a conventional residence, and a room-type ceiling further contributes to the home-like setting. The furniture is displayed in room-like groups along with appropriate accessories, decorator items, ceiling fixtures, etc., such that the customer can more accurately visualize how the furniture would appear in his home. Furthermore, related room settings correlated by the designated room or by the furniture style can be rapidly inspected and compared by the customer as he walks along the elongate aisles containing the repeated groupings of similar furniture.

By contrast, the small town furniture store typically having limited floor space offers a meager selection of household furnishings. The customer chooses from among randomly arranged floor samples, which is also the merchandise which he purchases. Due to the lack of warehouse facility, the selection presented to the customer is reduced in accordance with the merchandise sold pending the delivery of replacement items. To compensate for his limited stock, the proprietor usually has numerous catalogs published by various home furnishing manufacturers. In toto, the catalogs may be more replete with merchandise than any sales facility, including those in large metropolitan areas. Within these catalogs, the customer is certain to find the item which he desires. Accompanying the catalog illustration is a written description concerning the materials of construction, colors available, and other pertinent criteria.

Customers, however, have a preference to sample the merchandise. They like to feel the weight and strength of the material, view the colors and perform other personal inspections to insure themselves that the purchase is justified. When making a catalog purchase, the customer has difficulty adequately visualizing the furniture as it would appear within his home. Further, merchandise ordered from a catalog is usually shipped from some remote warehouse or the factory, causing considerable delay to the customer in receiving his merchandise. Since furniture manufacturing concerns operate on production run scheduling, the customer may be deprived of his merchandise for several weeks or even months until a run of that particular item is again scheduled.

Thus, it would be highly advantageous to retailers and to customers to provide a retail furniture sales facility especially adapted for limited population areas and providing optimum customer service.

Accordingly, it is an object of the present invention to provide an improved retail furniture sales facility.

Another object of the present invention is to provide a retail furniture sales facility which, while having a limited stock inventory, can present extensive selections for the customer's consideration.

Still another object of the present invention is to present varied displays of household furnishings including furniture, accessories, decorator items, selective wall coverings, floors, and background items, arranged in numerous room settings within a substantially reduced area compared to that required for conventional display.

Yet still another object of the present invention is to provide a complete display of home furnishings on a reduced scale in such manner that the customer may readily visualize the furniture as it would appear in his own home and also physically touch the materials of construction.

Yet still another object of the present invention is to provide the small town customer with a selection of home furnishings comparable to those available to metropolitan city customers.

A further object of the present invention is to provide a retail furniture sales facility as above described which may incorporate means for presenting selective furniture items for inspection by the customer while requiring no additional land area.

Still a further object of the present invention is the provision of a retail furniture sales facility as above which may include an integral warehouse haing a readily-available stock of the merchandise on display.

Yet still a further object of the present invention is to provide a combination showroom-warehouse retail furniture sales facility having the above-mentioned advantages which is arranged and constructed so as to improve the retail customer's awareness that he is purchasing his selections in a warehouse facility.

Briefly, to achieve the desired objectives in accordance with the invention, a display module is provided comprising an upright supporting structure having an illuminated photograph of a room setting having household furnishings arranged therein and a tactile display having fragmentary samples corresponding to the actual materials of construction of the furnishings shown in the photograph. Preferably, the photograph is a photographic transparency of an actual room setting of household furnishings including furniture, accessories, decorator items, selective floor coverings, walls and background items reproduced in full color. The diffused illumination behind the transparency assists in presenting a natural appearing room setting whereby the customer may readily visualize the home furnishings as they would appear within his own home. The photograph is retained in a frame in the upper portion of the display module proximate the eye level of the viewer. A panel below the photograph carries the tactile display. The tactile display includes fragmentary physical samples of the wood, cloth, hardware and other materials actually employed in the fabrication of the home furnishings displayed in the photograph. The tactile display provides the customer with the ability to touch and examine the texture of the home furnishings while viewing the home furnishings to intensify the reality of the photographic display. The display module can further include an elongate plate extending transversely between the photograph and the tactile display. Sales tags bearing the price and other descriptive indicia relative to the furniture items are secured upon the plate.

Several displays may be incorporated into an extended display module. The extended module is subdivided by vertical spaced partitions. Between each pair of partitions is a photograph, a tactile display and a plate bearing the sales tag as hereinbefore described. The several displays within each extended module are arranged according to type or style of furniture. For example, one module may contain all dining room sets or all living room suites or, alternately, one module may display mediterranean furniture while another displays colonial style furniture. A plurality of display modules are arranged with continuous access aisles therebetween providing ample room for the customer to walk along the display modules and readily compare the various furnishings displayed in each photograph. Walls and a roof are provided to form a building enclosing the display modules and the access aisles to form an improved compact furniture sales facility wherein extensive selections of home furnishings are presented for inspection by the customer within a store occupying minimal land area.

Where the area and population serviced by the retail furniture sales facility justifies the expenditure for additional services, a two-story building may be utilized. In this configuration, a mezzanine floor is supported above the display modules and the access aisles with a stairway, escalator or other suitable passage means communicating between the mezzanine floor and the access aisles. The mezzanine floor supports selective items of furniture for inspection by the customer. Each selective item of furniture is an actual item representative of the grouping displayed in one of the photographs. In a further modification, here again depending upon the area and population to be served, the retail sales facility includes an integral warehouse within the building. The warehouse facility includes a plurality of elongate storage racks arranged in parallel and spaced to have access aisles between the racks. The storage racks hold a readily available supply of the household furnishings displayed within the retail sales facility. Between the retail sales facility and the warehouse facility is a mutual access aisle having the aisles of the sales facility extending from one side thereof and the access aisles of the warehouse facility extending from the other side thereof. A customer entrance door at one end of the mutual access aisle affords the customer a simultaneous view of the sales facility and the warehouse facility upon entering the building. Adjacent the customer entrance door is a loading dock with a door communicating to the interior of the warehouse facility.

It will be immediately apparent to those skilled in the retail trade that the retail furniture sales facility as hereabove first described and including the display module is acceptable for erection in communities having limited populations. The capital investment to the merchant is minimal, yet the selection of furnishings presented for consideration by the customer equals that which is displayed to customers in heavily populated areas. Such facilities would normally be operated in connection with furniture warehouse facilities located in metropolitan areas. The metropolitan facility would be of the showroom-warehouse type which displays the same merchandise and has a large readily-available stock. Considering modern transportation and delivery means, furniture selected by the customer at a facility constructed in accordance with the teachings of the present invention could be dispatched via a telephone order from the metropolitan warehouse to be delivered to the customer's home within two or three days. This is approximately the same delivery schedule offered to customers by conventional retail furniture sales facilities within metropolitan downtown business areas which must have the items delivered from a warehouse located in the commercial district of the city. As further described above, the retail sales facility of the present invention may offer extended services to the customer including an integral warehouse in accordance with the sales potential of the area.

Further and more specific objects and advantages of the present invention will become more readily apparent from the following detailed description of a preferred embodiment thereof taken in conjunction with the drawings in which:

FIG. 13 is an elevation view in section of an alternately preferred facility of the type shown in FIG. 12.

Figure 1:
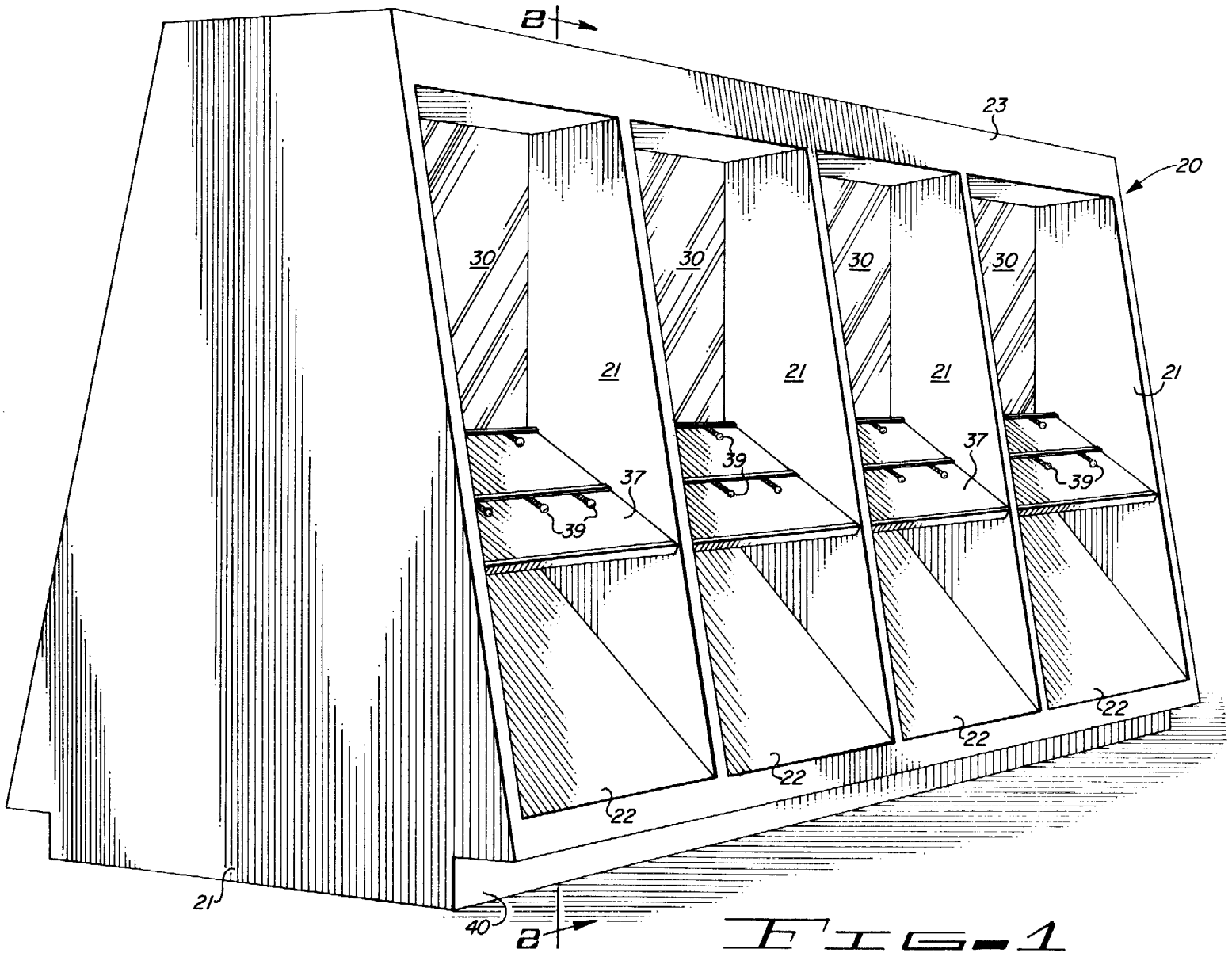
FIG. 1 is a perspective view of a display module constructed in accordance with the teachings of the present invention.
Figure 2:
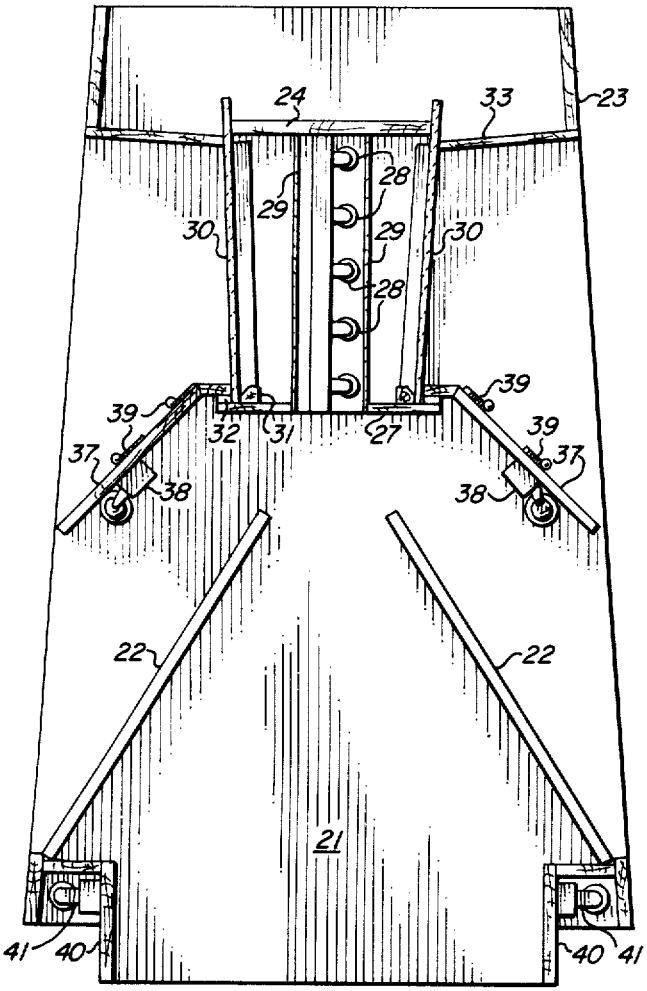
FIG. 2 is an elevation view, in section, taken along the line 2—2 of FIG. 1 particularly detailing the elemental components thereof.
Figure 3:
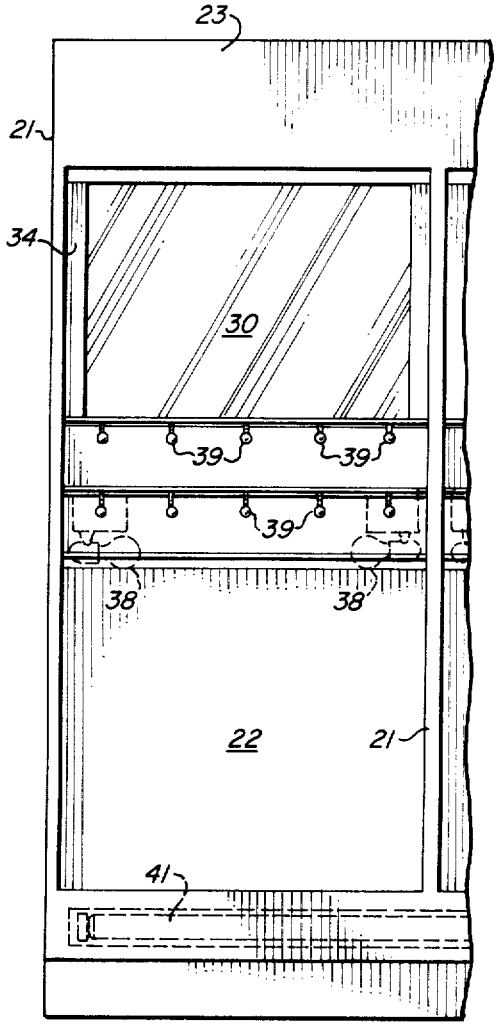
FIG. 3 is a partial frontal view of the device of FIG. 1.

Turning now to the drawings, in which the same reference numeral indicates corresponding elements throughout the several views, attention is first directed to FIGS. 1–3 which particularly illustrate a retail furniture sales display module constructed in accordance with the teachings of the present invention. The display module generally designated by the reference character 20 is an upright structure having upstanding aligned partitions 21. Each pair of partitions are maintained in a spaced parallel relationship by a pair of panels 22 in the lower portion thereof. An upper facia 23 maintains the relationship of the partitions at the upper end thereof.

A frame is disposed between each pair of panels. The frame has an upper member 24 and a lower member 27 which supports a plurality of fluorescent tube lights 28 proximate the center thereof such that the axis of the fluorescent tubes is longitudinally aligned between the partitions. A light diffusing plate 29, such as fabricated from a sheet of opaque plastic or frosted glass, is disposed on either side of the fluorescent tubes. A photographic transparency 30 is removably retained by the frame at each outboard edge thereof. The lower member 27 of the frame has a pair of spaced upright projections 31, 32 which receives the lower edge of the photographic transparency therebetween while the upper edge of the transparency 30 is retained against the upper member 24 of the frame by a header 33 extending inwardly from the facia 23. The photographic transparency, prior to being inserted into the display module, is first prepared in a lightweight picture frame 34 to prevent the transparency from bending or warping, which is then inserted from the top of the display module between the upper member 24 and the header 33 and downward until the lower edge of the frame 34 rests between the upright members 31, 32.

A pair of elongate plates 37 extend from either edge of the lower frame member 27. The elongate plate 37, as viewed in FIGS. 2 and 3, is horizontal in the frontal view and depends downward in the sectional view. Lighting fixtures 38 are carried on the underside of the plate 37 for illuminating the panel 22 while a plurality of spring clips 39 are aligned on the upper surface of the plate. In accordance with preferred construction procedures, an inset kickboard 40 extends the length of the display module along the bottom thereof. Fluorescent tube lights 41 are disposed above the kickboard 40 to provide floor illumination.

Figure 4:
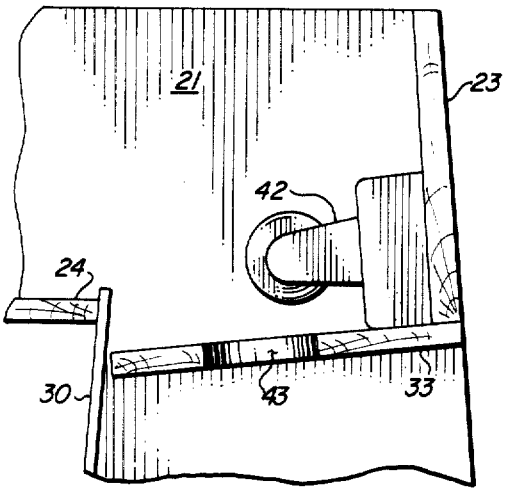
FIG. 4 is a fragmentary section corresponding to FIG. 2 and illustrating a preferred means of illuminating the price tags displayed thereon.

A preferred method of illuminating the plate 37 is specifically shown in FIG. 4. Herein a lighting fixture 42 is carried by the facia 23 above the header 33. The illumination from the light fixture shines through an aperture 43 within the header 33 to fall upon the plate 37. As will be readily apparent to those skilled in the art, if a solid photograph is substituted for the photographic transparency 30, the header 33 may be removed and the light fixture 40 replaced with a directed flood light to illuminate the photograph.

Figure 5:
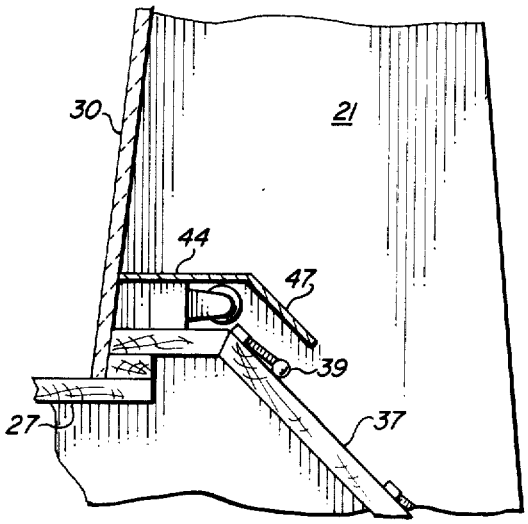
FIG. 5 is a fragmentary section corresponding to FIG. 2 and illustrating an alternate means of illuminating the price tags.

FIG. 5 illustrates an alternate method of illuminating the upper surface of the plate 37. Herein a light fixture 44 is disposed at the upper edge of the plate 37. A reflector 47 is carried above the light fixture 44 and has a downwardly depending outboard portion to direct the light rays downwardly upon the face of the plate 37.

Figure 6:
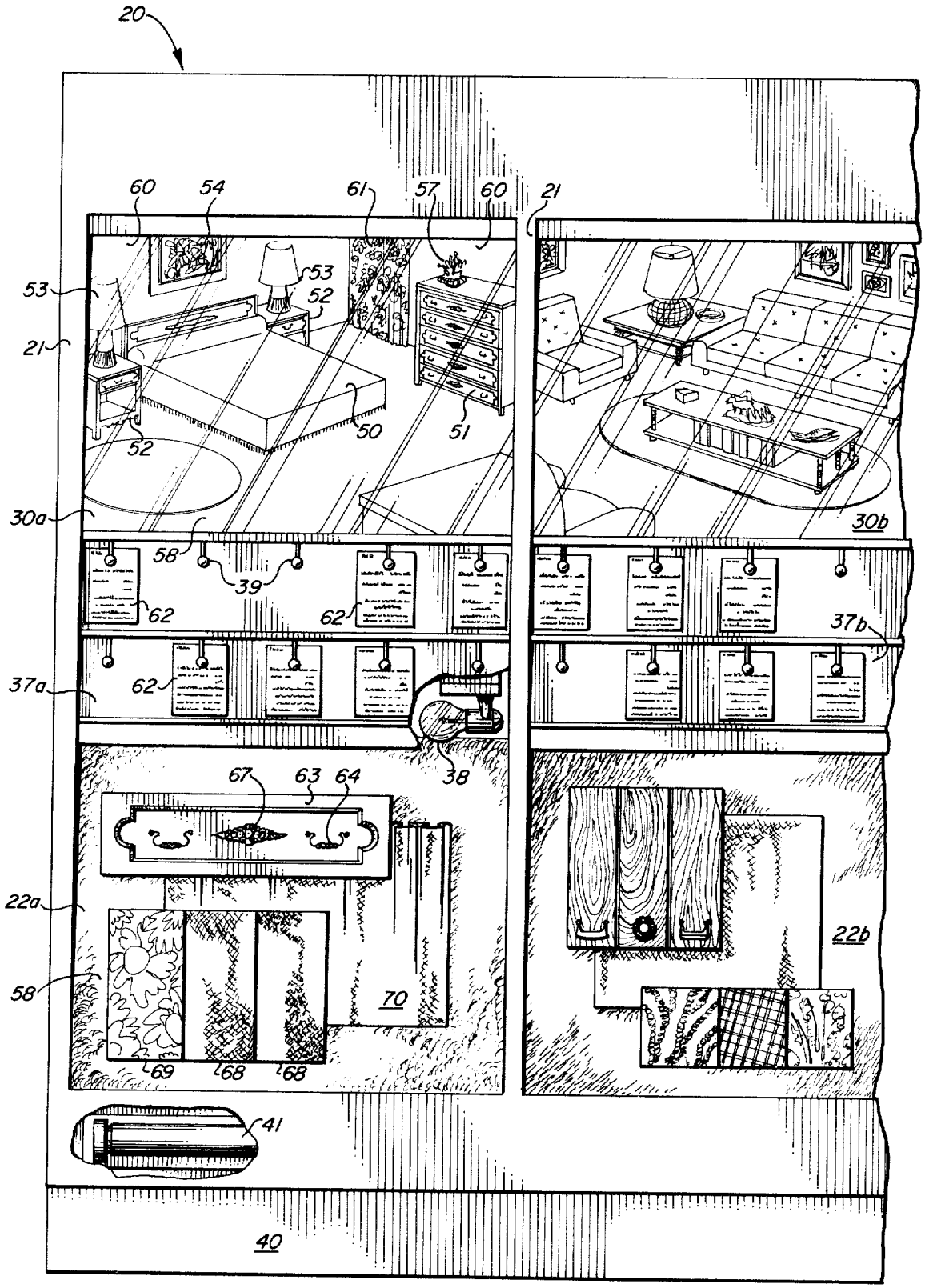
FIG. 6 is a fragmentary frontal view of the device of FIG. 1 as the device would appear within a retail furniture sales facility when viewed by the customer.

The function of the display module is most adequately described in connection with FIG. 6, in which the display module is illustrated as it would appear when viewed by the customer. Shown herein are two photographs 30*a* and 30*b* which depict room settings displaying a bedroom suite and a living room suite, respectively. Referring to the photograph 30*a*, shown therein is a room setting of household furnishings including such furniture items as a bed 50, a chest 51, commodes 52, accessories here shown as lamps 53, and decorator items including a wall-hung picture 54 and an object d'art 57. The room setting includes selective color-coordinated carpeting 58, a throw rug 59, walls 60 and background items represented by the drape 61.

Sales tags 62 are detachably retained upon the plate 37*a* by the spring clips 39. Each sales tag 62 corresonds to a given item of household furnishing displayed in the photograph 30*a* and bears indicia relative to that item. The sales tag may, for example, have the manufacturer's name, type of material of construction, colors available, stock number and sales price. The plate 22*a* carries a tactile display having fragmentary physical samples of materials used in the fabrication of the home furnishings displayed in the photograph 30*a* and described by the sales tags carried upon the plate 37*a*. As shown herein, the tactile display 22*a* has a drawer front 63 as actually used in the fabrication of the chest 51 or the commode 52. The drawer front 63 is complete with drawer pulls 64 and decorative trim 67. The two cloth samples 68 are representative of the material covering for the shade of the lamp 53, while the sample 69 is the covering for the mattress on the bed 50. The swatch 70 can alternately represent the spread upon the bed or the drape 61. To enhance the display, the panel 22*a* is first covered with a piece of the carpeting 58 upon which the fragmentary samples are then mounted.

Similar to the display hereinbefore just described, a living room suite is depicted in the photograph 30*b* and has associated sales tags upon the plate 37*b* and a tactile display upon the panel 22*b*. As shown herein, the photographs 30*a* and 30*b* represent bedroom furniture and living room furniture, respectively, both being of the same style. Other displays within the module may display dining room furniture, den furniture and family room furniture, all pictorial displays representing the same style of furniture. In an alternate arrangement, the display module may display all furniture suitable for the same room except in different styles to afford the customer a ready comparison among the various styles.

The photograph 30 being a photographic transparency and being illuminated to life-like intensity by the fluorescent tubes 28 assists the customer in viewing the furniture as it might appear in his own home. Floor covering and accessory items further enhance the customer's visualization. While viewing the photographic display, the customer may examine by touch the fragmentary samples of the tactile display to heighten his awareness and conception of the actual items of furniture. The customer may gain further information of those items in which he is interested from the sales tag. If the customer desires to ask further questions of a salesman or purchase an item of furniture, he may do so by referring to the stock number displayed on the sales tag.

Figure 7:
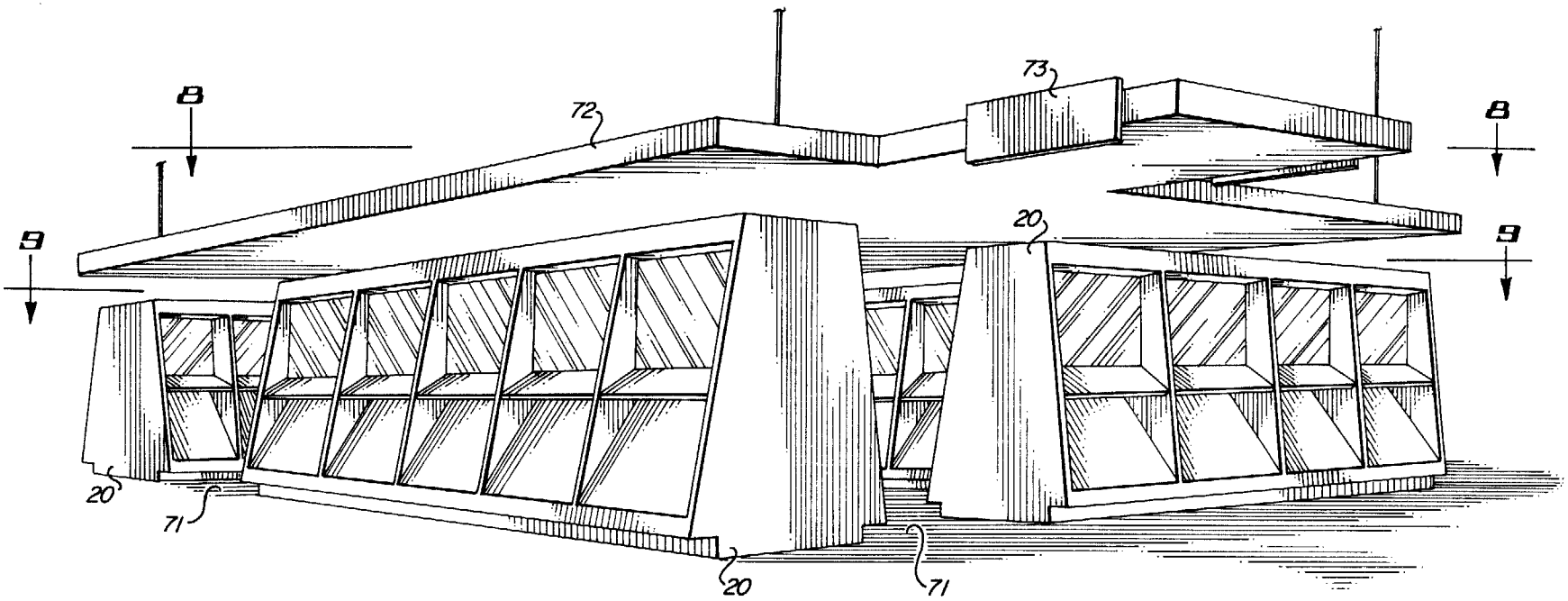
FIG. 7 shows a preferred arrangement of the display modules within a retail furniture sales facility.
Figure 8:
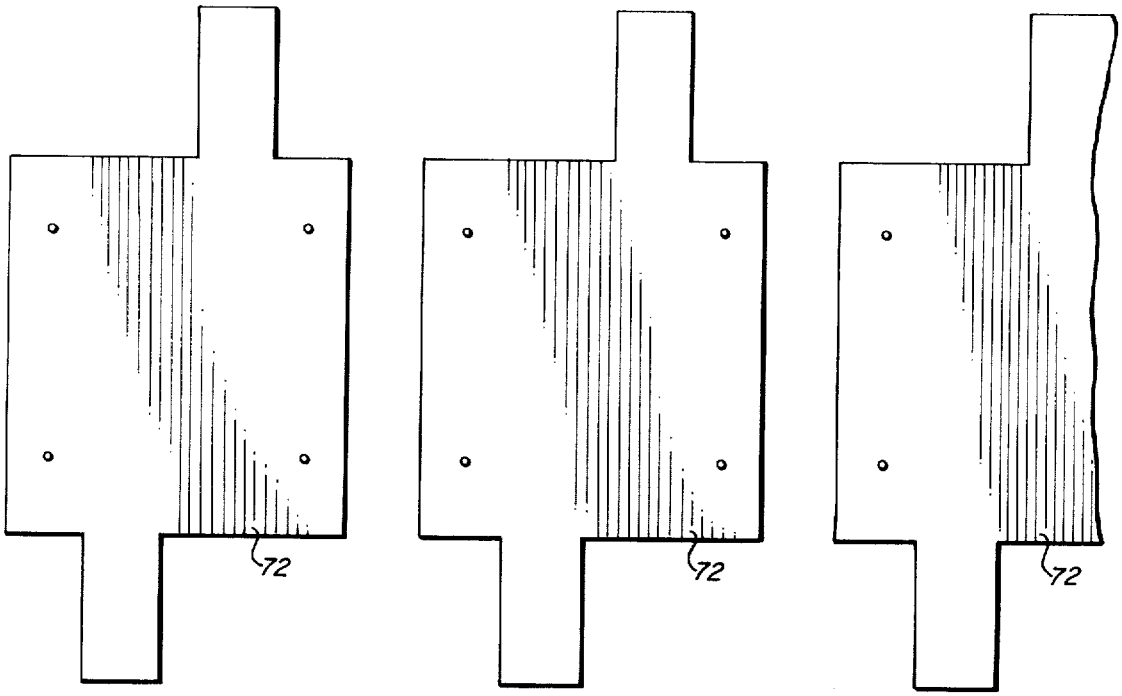
FIG. 8 is a plan view taken along the line 8—8 of FIG. 7.
Figure 9:
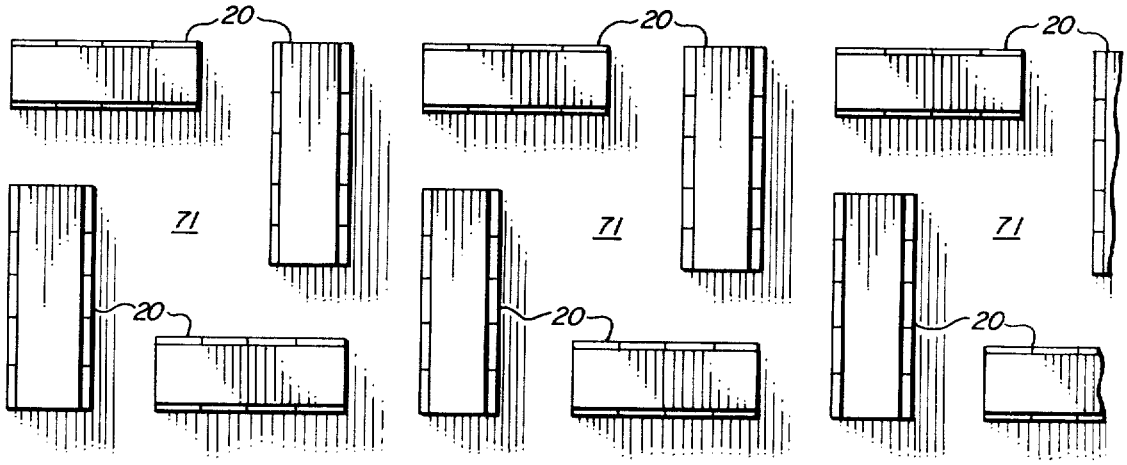
FIG. 9 is a plan view taken along the line 9—9 of FIG. 7.

FIGS. 7–9 illustrate a preferred arrangement of the display modules 20 within a retail sales facility. The unique arrangement of the display modules arranged at opposing angles with continuous access aisles 71 extending therebetween presents a pastoral furniture sales facility to the customer. The pastoral arrangement is conducive to simulating the feeling that one may have within his own home, whereby he may browse and view the displays without the ever-present awareness that he is, in fact, in a retail sales facility. The false ceiling 72 lowered to approximate the height within his home is further conducive to the atmosphere. A display sign 73 may announce the type or style of furniture displayed within the modules under the designated false ceiling.

Figure 10:
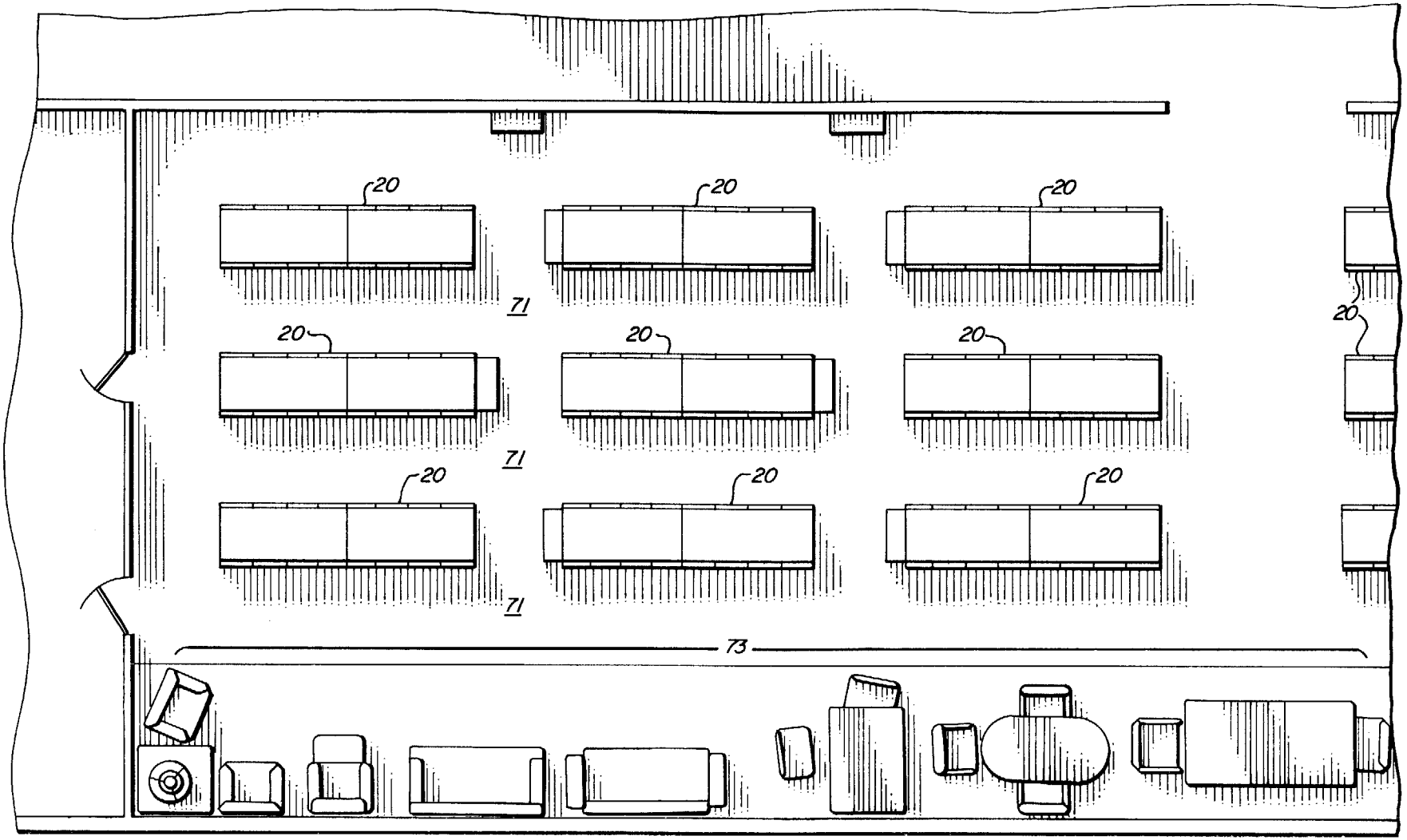
FIG. 10 is a view corresponding to FIG. 9 and showing an alternately preferred arrangement of the display modules.

FIG. 10 shows a more conventional arrangement of the display modules 20 wherein the display modules are aligned in rows with continuous access aisles 71 therebetween. A display area 73 contains actual representative items of furniture displayed within the display modules 20.

Figure 11:
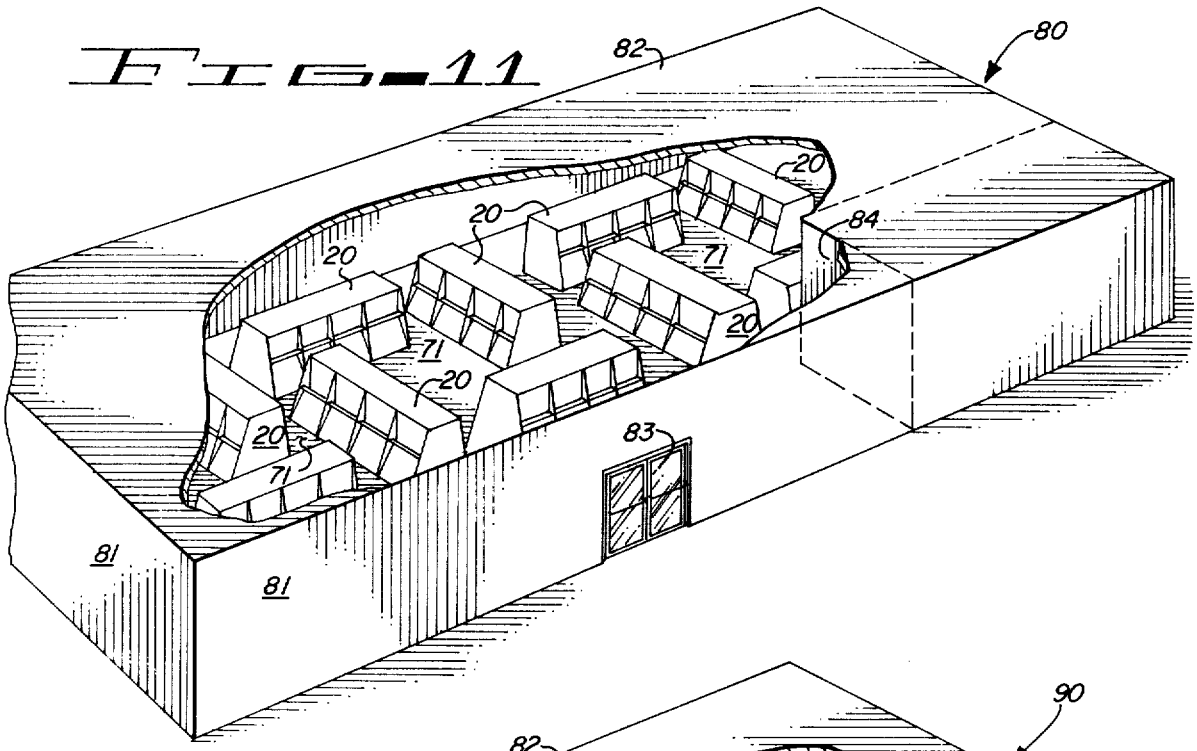
FIG. 11 is a retail furniture sales facility constructed in accordance with the teachings of the present invention partially broken away to illustrate the interior arrangement thereof.

FIG. 11 illustrates a compact retail furniture sales building 80 having walls 81, a roof 82 and a customer entrance door 83. In one section of the building is a sales office 84. Display modules 20 are arranged upon the showroom floor of the sales facility building 80. Continuous access aisles 71 extend between the display modules 20.

Figure 12:
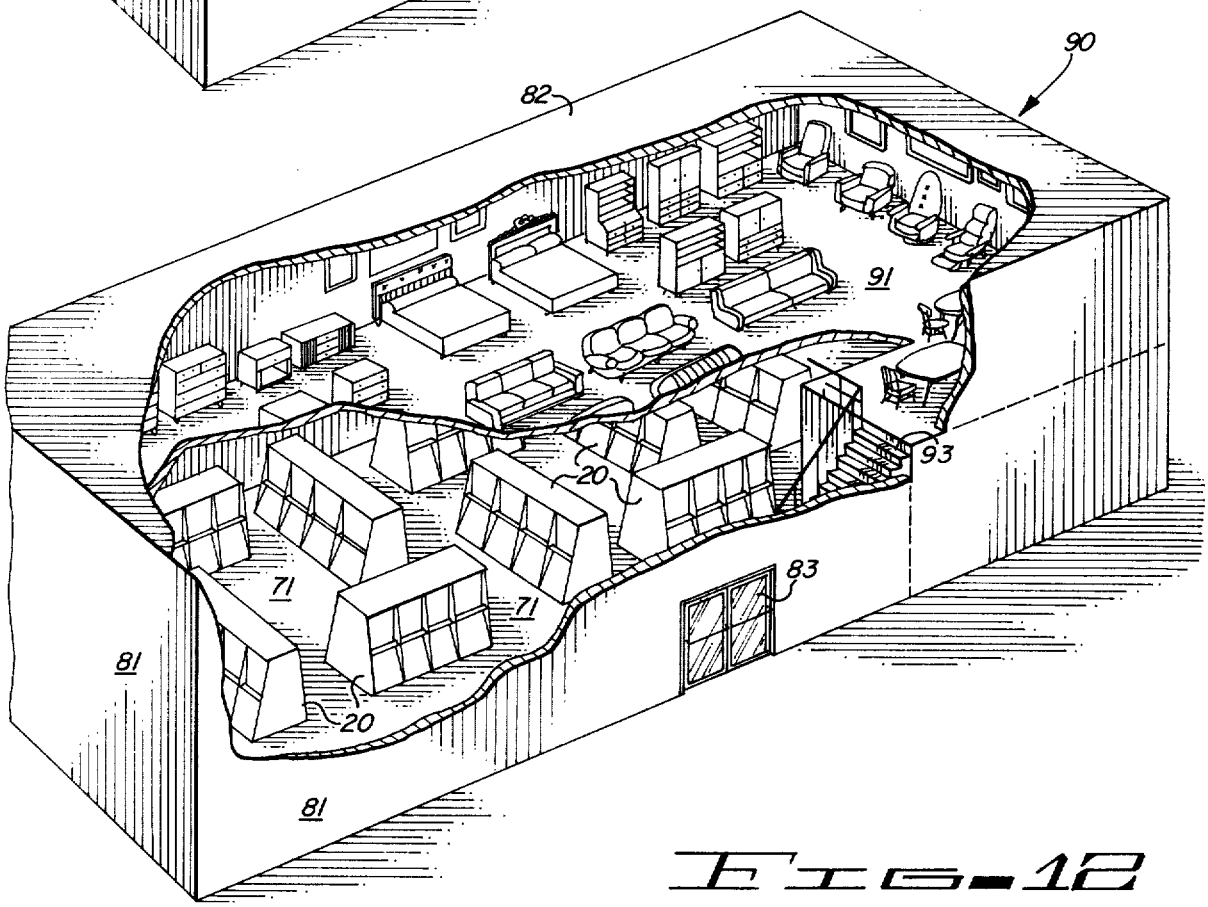
FIG. 12 is a perspective view of an alternately constructed retail furniture sales facility and partially broken away to reveal the interior arrangement thereof including the mezzanine floor.
Figure 19:
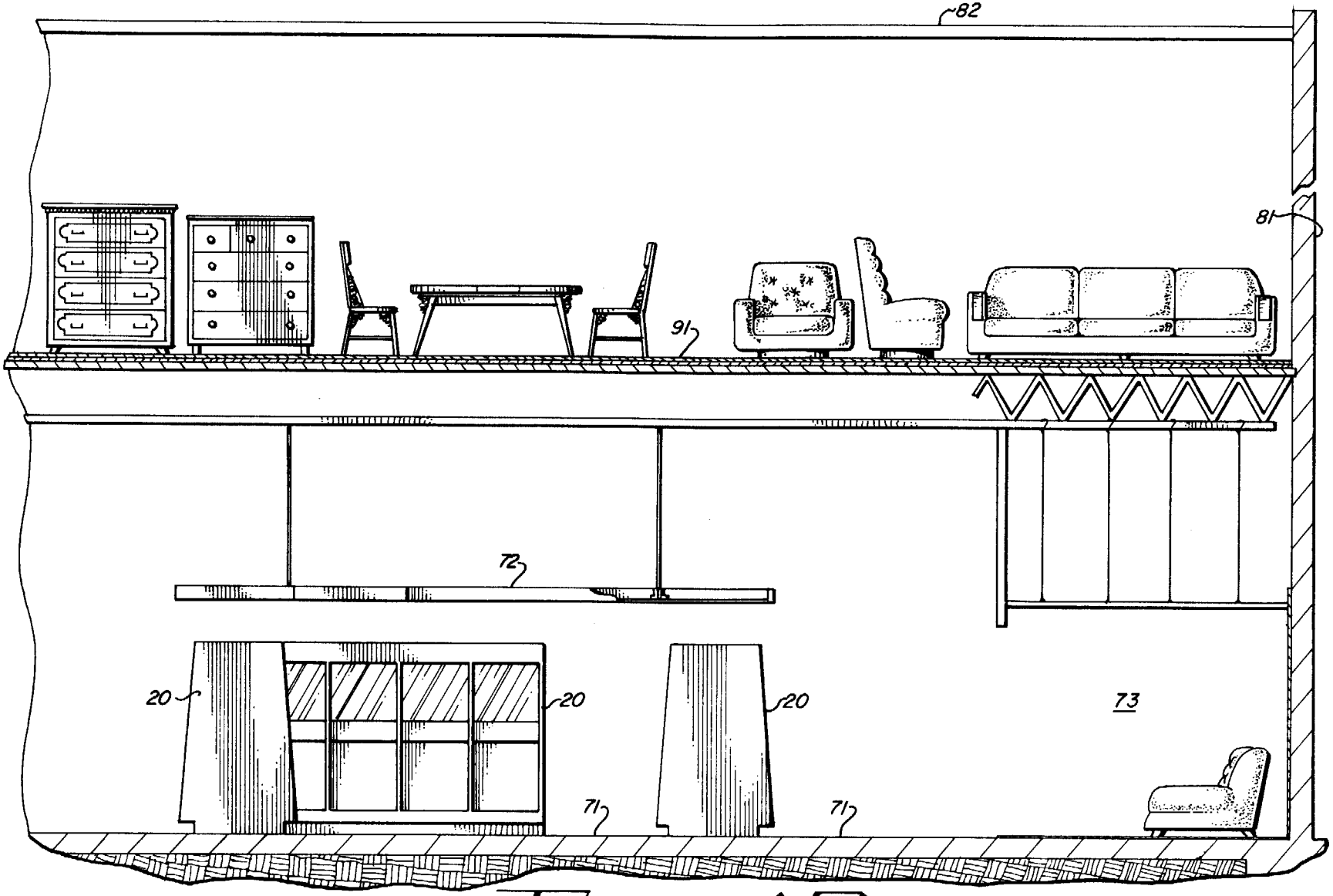

An alternate retail furniture sales facility is shown in FIG. 12. Herein, the building 90 has a mezzanine floor 91, which supports selective items of furniture representative of the items illustrated within the display modules 20. Stairs 93 communicate between the access aisles 71 and the mezzanine floor 91. The building 90 is applicable for construction in those areas where the population serviced by the retail sales facility justifies the erection of a more sophisticated building than the one described in connection with FIG. 11. Herein, the customer may inspect actual furniture items. It is understood that the furniture displayed upon the mezzanine floor 91 is not arranged in group settings nor in complete suites or units, but are actual physical samples representative of the merchandise displayed within the display modules 20. The building 93*a* illustrated in FIG. 13 is a modification of the building 90. The walls 81 are substantially taller, thereby raising the mezzanine floor and permitting use of the dropped false ceilings 72 over grouped arrangements of the display modules 20. An auxillary furniture display area 73 extends along one wall of the building spaced from the display modules 20 by the continuous access aisle 71.

Figure 14:
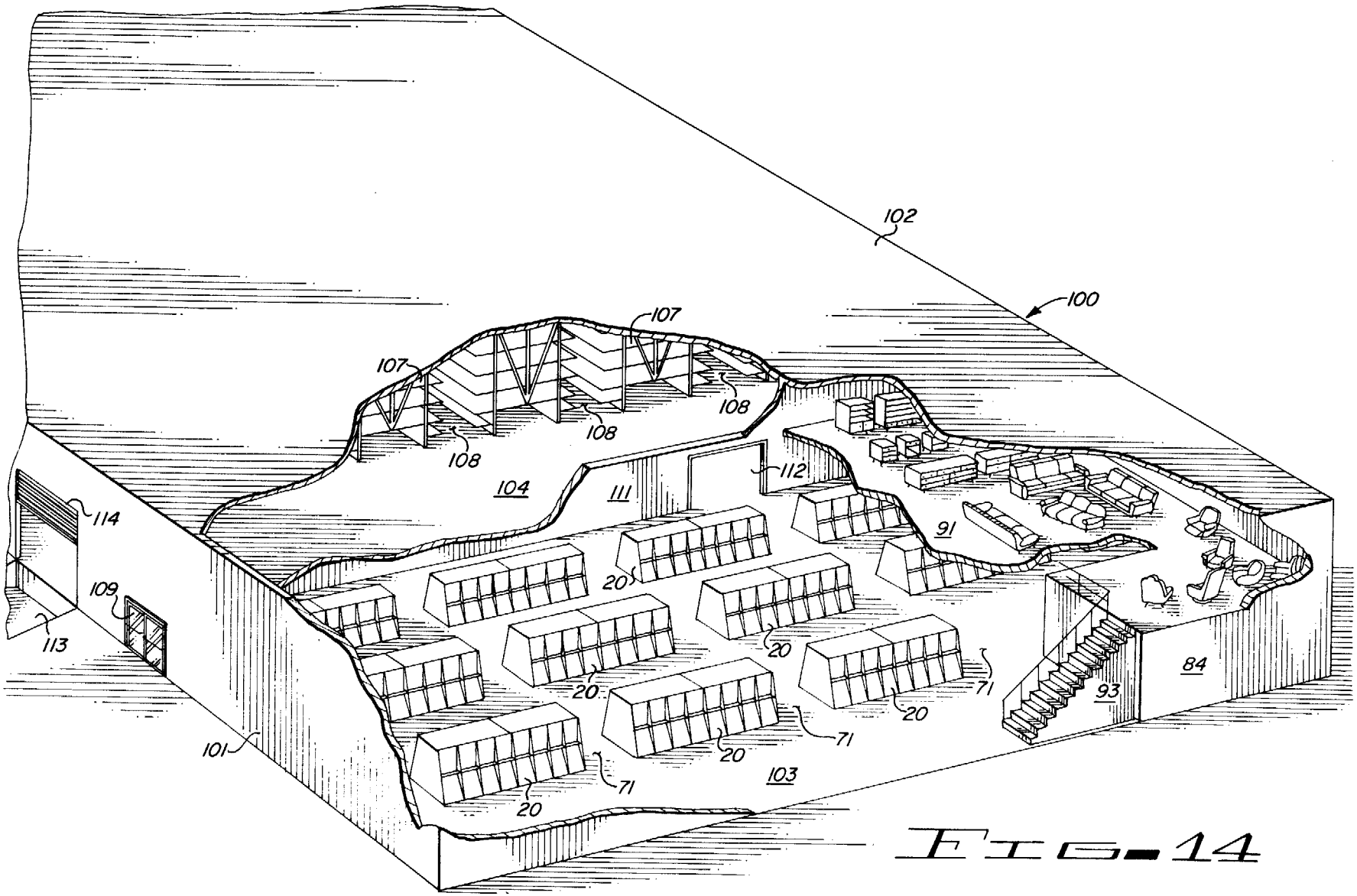
FIG. 14 is a retail furniture sales facility corresponding to the facility shown in FIG. 12 and including a warehouse storage facility.

FIG. 14 shows a further modified building 100 having walls 101 and a roof 102. The building is sub-divided into a retail furniture sales facility 103 and a warehouse facility 104. The sales facility 103 is analogous to the display facility described in connection with FIG. 12 having a mezzanine floor 91, display modules 20 and continuous access aisles 71. The warehouse facility has a plurality of elongate storage racks 107 having continuous access aisles 108 therebetween. A customer entrance door 109 is located in one wall 101 of the building, which opens directly to a mutual access aisle 110 extending laterally across the building between the sales facility 103 and the warehouse facility 14. The access aisles 108 of the warehouse facility extend perpendicularly from one side of the mutual access aisle while the access aisle 71 of the sales facility extends from the other side thereof. A wall 111 may preferably be disposed between the mutual access aisle 108 and the sales facility 103 such that the customer upon entering through the door 109 can view the warehouse facility before entering the sales facility through the doorway 112. A loading dock 113 having a door 114 associated therewith is located adjacent the customer entrance door 109. The door 114 affords direct access to the warehouse facility 104. A customer, after having made his selection within the sales facility, may have his purchase directly loaded into his personal vehicle at the loading dock 113 to take his purchase home immediately after purchase. Obviously, the facility described in connection with FIG. 14 would service a rather populous area. However, by incorporating the display modules 20 and the tiered storage racks 107, the facility may be appropriately constructed in areas where the customer potential would prohibit a conventional retail sales facility and a conventional warehouse facility.

It is apparent from the foregoing detailed description of the preferred embodiments that a retail furniture sales facility constructed in accordance with the teachings of the present invention can provide the small town customer with a selection of home furnishings comparable to those available to metropolitan city customers. When such a facility is operated in connection with a furniture warehouse or furniture showroom-warehouse located in a metropolitan area, the customer's selection can be delivered within the normal delivery time the metropolitan city customer would expect when purchasing his furniture items from a conventional furniture store. The retail furniture sales facility as specifically described in FIG. 14 especially adapted for construction in a more populous area is a combination showroom-warehouse retail furniture sales facility which is arranged to improve the retail customer's awareness that he is purchasing his selections in a warehouse facility and, therefore, offered the advantages normally reserved to customers residing in large metropolitan areas.

Having fully disclosed and described the invention and the preferred embodiment thereof in such clear and concise terms as to enable those skilled in the art to understand and practice the same, what is claimed is:

1. A retail sales facility for displaying numerous room settings of household furnishings including furniture, accessories, decorator items, selective floor covering, walls and background items for consideration by the customer in a reduced space compared to that required for actual physical display, said facility comprising:

a. a plurality of display modules having access aisles therebetween and including
   i. an upright supporting structure;
   ii. a photograph carried by said supporting structure of said room setting, having said household furnishings arranged therein;
   iii. means for illuminating said photograph;
   iv. a tactile display, located adjacent said photograph, having fragmentary, physical samples corresponding to the actual materials of construction of the furnishings shown in the photograph; and b. a mezzanine floor supported above said display modules and access aisles;

c. passage means communicating between said access aisles and said mezzanine floor
   i. said mezzanine floor supporting selective items of furniture for inspection by the customer, each said item of furniture being an actual item as photographically displayed; and d. wall, roof, and door means defining a building enclosing said display modules, said mezzanine floor, and said access aisles.

2. A retail sales and warehouse facility for displaying numerous room settings of household furnishings including furniture accessories, decorator items, selective floor coverings, walls and background items for consideration by the customer in a reduced space compared to that required for actual physical display and for storing items of said displayed household furnishings for delivery to the customer, said facility comprising:

a. a retail sales facility including a plurality of display modules having access aisles therebetween and including
   i. an upright supporting structure;
   ii. a photograph carried by said supporting structure of said room setting, having said household furnishings arranged therein;
   iii. means for illuminating said photograph;
   iv. a tactile display, located adjacent said photograph, having fragmentary physical samples corresponding to the actual materials of construction of the furnishings shown in the photograph;

b. a warehouse facility including
   i. a plurality of tiered elongate storage racks arranged longitudinally parallel, said racks sized to hold a readily available supply of the household furnishings displayed in said photographs,
   ii. access aisles extending between said racks;

c. a mutual access aisle extending between said sales facility and said warehouse facility, whereby said access aisles of said warehouse facility extend perpendicularly from one side of said mutual aisle and said access aisles of said sales facility extend from the other side of said mutual aisle;

d. a customer entrance door in said facility at one end of said mutual aisle, whereby a customer entering through said door can view said warehouse facility before entering said sales facility;

e. a furniture loading dock integral with said warehouse facility adjacent said customer entrance door; and f. exterior door means associated with said loading dock.

* * * * *